US005416285A

United States Patent [19]

Niehaus

[11] Patent Number: 5,416,285

[45] Date of Patent: May 16, 1995

[54] ACOUSTICAL DOOR

[75] Inventor: Paul W. Niehaus, Appleton, Wis.

[73] Assignee: Eggers Industries, Neenah, Wis.

[21] Appl. No.: 168,863

[22] Filed: Dec. 17, 1993

[51] Int. Cl.[6] ..... E04B 1/343

[52] U.S. Cl. ..... 181/287; 181/290

[58] Field of Search ..... 181/292, 284, 286, 287, 181/288, 290, 291, 294, 295; 52/144

[56] References Cited

U.S. PATENT DOCUMENTS

| | | | |
|---|---|---|---|
| 2,085,436 | 6/1937 | Maurer | 181/287 |
| 2,116,270 | 5/1938 | LeGrand . | |
| 2,614,295 | 10/1952 | Een | 181/287 |
| 3,553,913 | 1/1971 | Eisenberg | 52/144 X |
| 3,875,706 | 4/1975 | Okawa | 52/144 X |
| 4,057,123 | 11/1977 | Erickson | 181/286 |
| 4,214,646 | 7/1980 | Planes et al. | 181/287 |
| 4,487,291 | 12/1984 | Walker | 181/290 |
| 4,621,709 | 11/1986 | Naslund | 181/284 |
| 4,759,000 | 7/1988 | Reitz | 181/286 X |
| 4,924,969 | 5/1990 | L'Heureux | 181/290 |
| 4,992,320 | 2/1991 | Gower | 181/290 X |
| 4,998,598 | 3/1991 | Mardian et al. | 181/284 |
| 5,057,176 | 10/1991 | Bainbridge | 181/286 X |

FOREIGN PATENT DOCUMENTS 860682 6/1958 United Kingdom .

*Primary Examiner*—M. L. Gellner
*Assistant Examiner*—Khanh Dang
*Attorney, Agent, or Firm*—Michael, Best & Friedrich

[57] ABSTRACT

An acoustical door including a multiple ply core with individual plies separated from one another by intervening spacer networks. The networks provide generally uniform sound damping spaces between the core plies and are glued in position between the plies to bond the core together.

7 Claims, 2 Drawing Sheets

ACOUSTICAL DOOR

BACKGROUND OF THE INVENTION

1. Field of the Invention

The invention relates generally to wall structures having enhanced sound insulating or absorbing properties, and more particularly to acoustical doors having interior sound damping spaces or voids.

2. Reference to Prior Art

Acoustical wall structures such as doors, wall panels and the like are intended to minimize sound transmission therethrough to insulate a space from outside noise. Sound insulating wall structures can be constructed with considerable mass to reduce sound transmission. However, the use of heavy wall structures to achieve adequate sound insulating properties is often uneconomical or impractical. An example of a more economical lightweight acoustical door construction is illustrated in U.S. Pat. No. 4,998,598 issued Mar. 12, 1991. That acoustical door has multi-layered door panels each having an outer layer of plywood veneer, an inner layer of hardboard, and an intermediate layer of vinyl. The door panels are glued to a frame to enclose an air space that is completely filled with a fibrous sound absorbing material.

It is known to provide lightweight wall constructions with sound damping or absorbing interior air gaps or spaces to achieve sufficient sound insulating properties. Examples of such wall constructions are provided in U.S. Pat. No. 2,085,436 issued Jun. 29, 1937, U.S. Pat. No. 2,116,270 issued May 3, 1938, and U.S. Pat. No. 2,614,295 issued Oct. 21, 1952. In particular, U.S. Pat. No. 2,085,436 illustrates a soundproof wall or partition. The construction of the partition is somewhat complicated and includes opposite side panels separated by wooden posts to provide a sound absorbing dead air space in which an intermediate panel or core made of sound absorbing loose fibrous material is positioned. Each of the side panels has a multiple ply construction including an outer ply made of compressed wood fibers, an intermediate felt ply separated from the outer ply by an air space, and an inner ply of compressed wood fibers separated from the intermediate ply by another air space. The air spaces in the side panels are provided by individually attaching the plies to successively stepped portions of a panel framework. Thus, the plies are different sizes to fit within the windows formed by the corresponding stepped frame portions.

SUMMARY OF THE INVENTION

The invention provides an improved acoustical wall construction, and particularly an improved acoustical door, which effectively reduces sound transmission and increases sound absorption to reduce reverberation within a room. The acoustical door is light weight and can be efficiently and economically assembled to include sound absorbing dead air spaces between plies of a multiple ply core. The core plies include intervening spacer plies or networks that are glued in a desired pattern between successive panel plies to provide generally uniform air spaces or gaps between the panel plies.

More particularly, the invention provides an acoustical wall section which in one embodiment is a door. The door includes a laminated core having alternating panel plies and spacer plies to provide air spaces between each of the panel plies. Each spacer ply is formed of a network of separate spacer strips that are sandwiched between a pair of the panel plies. In one embodiment each spacer strip network includes lateral and longitudinal spacer strips that are bonded to the lateral and longitudinal peripheral edge portions of a pair of panel plies. Inner spacer members are also provided to support the inner portions of the panel plies when the core is cold pressed so that the spaces between the panel plies have a generally uniform thickness and so that the panel plies do not sag relative to each other. The door is also provided with exterior side panels that can include a decorative exterior finish, and endrails and side stiles to trim the door.

The door is formed by gluing panel plies and spacer plies together in an alternating pattern so that the spacer plies separate the panel plies. In particular, one of the spacer networks is placed over a panel ply and bonded thereto before the succeeding panel ply is positioned over the spacer network. This process is repeated until a core is formed having the desired number of plies. Care should be taken to overlay successive plies in coextensive relation with preceeding plies so that trimming of the edges of the core is minimized or eliminated.

Other features and advantages of the invention will become apparent to those skilled in the art upon review of the following detailed description, claims and drawings.

Figure 1:
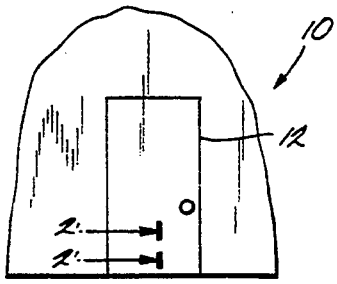
FIG. 1 is an elevational view of a wall construction including an acoustical door embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF A PREFERRED EMBODIMENT

Figure 2:
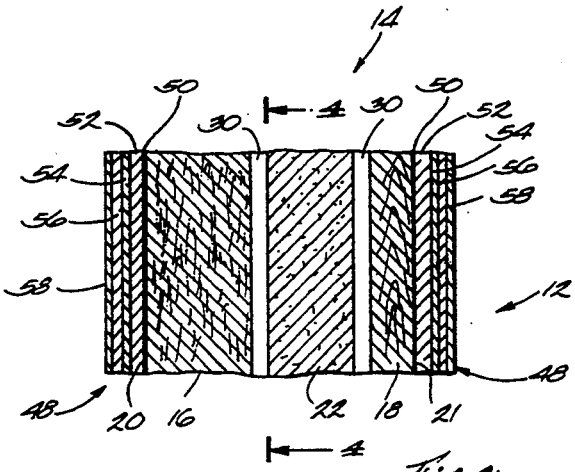
FIG. 2 is an enlarged cross-sectional view taken generally along line 2—2 in FIG. 1.
Figure 3:
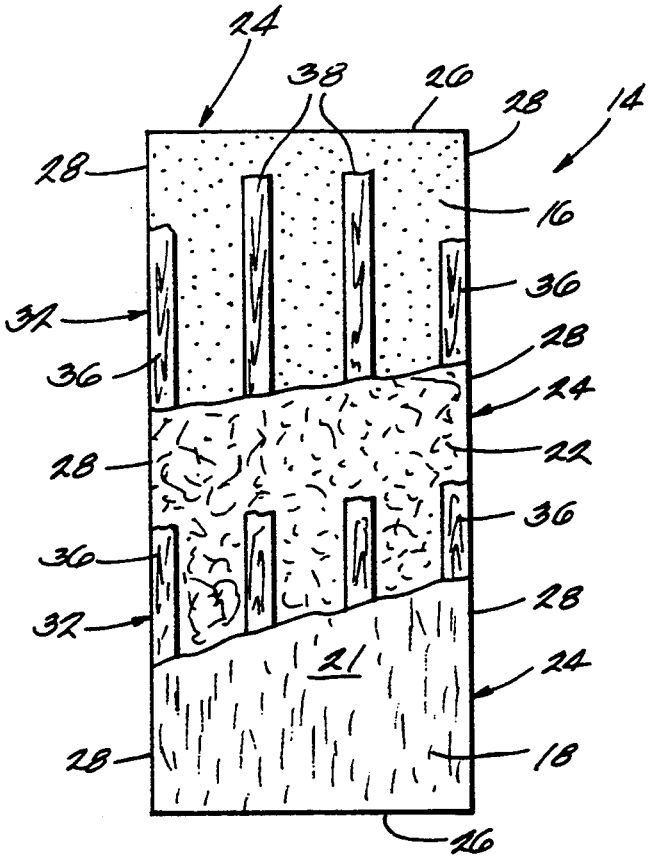
FIG. 3 is an enlarged plan view of the core of the door illustrated in FIGS. 1 and 2, with portions broken away to reveal the laminated structure of the core.

Illustrated in FIG. 1 is a wall 10 provided with an acoustical door 12 that is mounted in a doorway and that embodies various features of the invention. In the illustrated arrangement, the door 12 has a laminated construction and includes (FIG. 2) a sound insulating-/absorbing core 14. The illustrated core 14 has a multiple ply construction and includes opposite sheet-like outer skins or panel plies 16 and 18 each having an outer surface that provides the core 14 with opposite exterior sides 20 and 21. The core 14 also includes a sheet-like inner skin or panel ply 22 sandwiched between the outer panel plies 16 and 18. Each of the panel plies 16, 18 and 22 has (FIGS. 3 and 4) a rectangular periphery 24 including opposite lateral edge portions 26 and opposite longitudinal edge portions 28.

While the outer panel plies 16 and 18 and the inner panel ply 22 can be made of a variety of materials of varying thicknesses to suit the particular application, in the illustrated embodiment outer panel ply 16 is made of ½ inch thick medium density fiberboard and outer panel ply 18 is made of 3/16 inch thick hardboard. This provides the core 14 with fire retardant capabilities to qualify the door 12 as a 20-minute fire door. The inner panel ply 22 is made of ½ inch thick sound insulating/absorbing material. A suitable sound/insulating material is soundstop board sold under the name CELOTEX by Celotex Corp. of Tampa, Fla.

Figure 4:
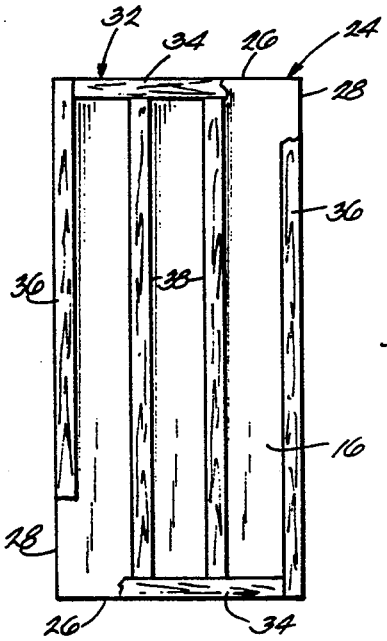
FIG. 4 is a view similar to FIG. 3 but which is taken along line 4—4 in FIG. 2 and partially broken away to show the arrangement of spacers on one of the core panel plies.

To provide intervening air gaps or spaces 30 (see FIG. 2) between the panel plies 16, 18 and 22 to absorb or damp sound, the core 14 is provided with spacer means for separating the individual panel plies from each other. In the illustrated embodiment, the spacer means includes (FIG. 3) a pair of spacer plies 32 that alternate with the panel plies 16, 18 and 22. As shown in FIG. 4, each of the spacer plies 32 is formed by a network of spacer members or strips including a pair of peripheral or outer lateral spacer strips 34 and a pair of peripheral or outer longitudinal spacer strips 36. The lateral spacer strips 34 and the longitudinal spacer strips 36 are adhesively bonded or glued to the lateral edge portions 26 and the longitudinal edge portions 28, respectively, of a pair of the panel plies 16, 18 and 22. A suitable adhesive bond or glue material is an isocyanate adhesive available from Ashland Chemical Co. of Columbus, Ohio.

The lateral and longitudinal spacer strips 34 and 36 are preferably confined substantially entirely within the peripheries 24 of the panel plies 16, 18 and 22, and are preferably flush with the peripheral edges of the panel plies 16, 18 and 22 (i.e., the panel plies 16, 18 and 22 and the spacer plies 32 are coextensive). Thus, the outer edges of the core 14 are substantially flat to minimize the need to trim the core 14, as is further explained below.

Each spacer ply 32 also includes a pair of inner spacer strips 38 glued between a pair of the panel plies 16, 18 and 22 at positions spaced inwardly of the peripheries 24 of the panel plies. The inner spacer strips 38 provide additional bond areas for bonding the panel plies 16, 18 and 22 together and also support the panel plies relative to one another in midspan areas.

While the spacer strips 34, 36 and 38 can be variously configured, in the illustrated arrangement each is about 2 inches wide and ⅛ inch thick and is made of wood.

Figure 5:
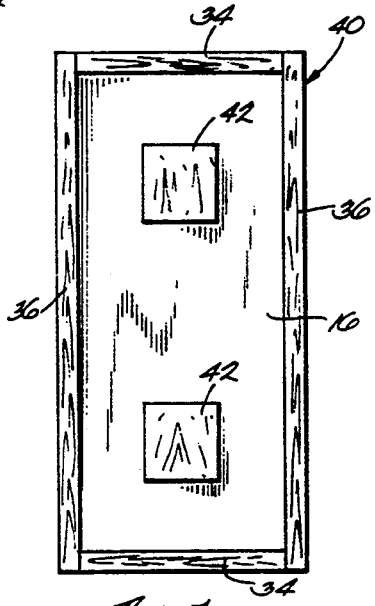
FIG. 5 is a view similar to FIG. 4 and shows an alternative spacer arrangement.

The configuration of the spacer plies 32 can be varied, if desired, without significantly affecting the sound insulating or absorbing characteristics of the core 14. For example, illustrated in FIG. 5 is a spacer ply 40 which can be substituted for spacer plies 32. Spacer ply 40 is similar to spacer plies 32 except that the inner spacer strips 38 are replaced with sheet-like wooden spacer members 42. The spacer members 42, like the inner spacer strips 38, are glued to the opposed faces of a pair of the panel plies 16, 18, 22 to bond those panel plies together.

Figure 6:
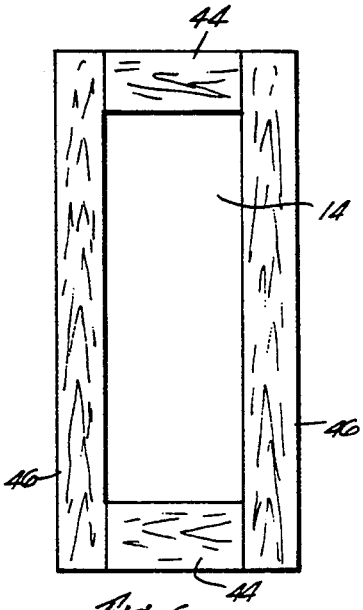
FIG. 6 is a plan view of the endrail and side stile layout for the door illustrated in FIG. 1.

The door 12 also includes (FIG. 6) endrails 44 and side stiles 46 that are used to trim the core 14. The endrails 44 and the side stiles 44 are generally U-shaped to fit over the edges of the core 14 and are glued thereon. In particular, the endrails 44 fit over the top and bottom edges of the core 14, and the side stiles 44 fit over the side edges of the core 14. The endrails 44 and side stiles 46 seal and cover the outer edges of the core 14 and, if desired, provide a decorative finish to the exterior edges of the core 14.

The door 12 also includes (FIG. 2) opposite exterior panels or skins 48 each glued to one of the exterior sides 20 and 21 of the core 14. Each of the exterior skins 48 has a laminated structure including a base sheet 50 of material that is known as CREZON and that is sold by Simpson Timber Co. of Portland, Oreg., a vinyl barrier layer 52, a backer veneer layer 54, a crossband layer 56, and a face veneer layer 58 which can have a decorative outer surface.

Figure 7:
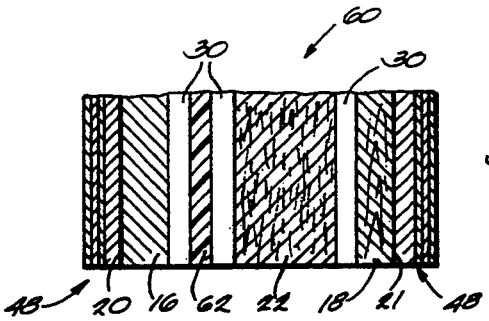
FIG. 7 is an enlarged cross-sectional view, similar to FIG. 2, but showing a door having a four-ply core arrangement.

While in the embodiment illustrated in FIGS. 1–6 the core 14 has a 3-panel ply construction, the number of panel plies employed in the core 14 can be varied to tailor the door 12 to its particular application. For example, illustrated in FIG. 7 is an alternative core construction 60 which is similar to core 14 but which has a 4-panel ply construction. In particular, the core 60 includes a second inner panel ply 62 made of ⅛ inch thick vinyl and an additional spacer ply 32 to provide an additional space 30 within the core 60. Also, in the illustrated arrangement the hardboard outer panel ply 18 is only ¼ inch thick so that the core 60 has the same thickness as the core 14. In the illustrated arrangement, the 4-panel ply core 60 can be used to provide a door with a better acoustical rating (i.e., rating of about STC-40 or better, for example, as compared to a rating of about STC-39 for the door 12 made with the 3-panel ply core 14).

In the manufacture of the door 12, the core 14 (or core 60) is formed by bonding together the panel plies 16, 18 and 22 and the spacer plies 32 (or 40 if desired) in an alternating pattern so that a spacer ply 32 intervenes between each pair of panel plies. This is done by gluing the outer lateral and longitudinal spacer strips 34 and 36 around the periphery 24 of one of the outer panel plies 16 and 18 (preferably the medium density fiberboard panel ply 16), and gluing the inner spacer strips 38 (or members 42) to that panel ply at locations spaced inwardly from the periphery 24 thereof. The spacer strips 34, 36 and 38 are then tacked in place, such as with staples for example, to hold them in position when the inner panel ply 22 is subsequently placed over the spacer ply 32. Additional spacer and panel plies are added by repeating the above steps until a core construction having a desired ply arrangement and thickness is achieved.

After the laminated core 14 (or 56) is fully assembled it is cold pressed at a pressure of about 7 psi until the glue is properly cured (i.e., about four hours). Following removal of the core 14 from the press (not shown), it is trimmed if necessary, and the endrails 44 and the side stiles 46 are installed by fitting those pieces over the edges of the core 14 and gluing them to the core 14. The core 14 is then placed in an apparatus (not shown) known to those skilled in the art as a Mann Russell to press the endrails 44 and side stiles 46 onto the core 14 at a pressure of about 90 psi for a time period of about one and one-half to two and one-half minutes.

Following attachment of the endrails 44 and the side stiles 46 to the core 14, glue is applied to the exterior skins 48 and those skins are placed over the exterior sides 20 and 21 of the core 14. Thereafter, the door 12 is placed in a press apparatus (not shown) to press the exterior skins 48 to the core 14 until the glue is sufficiently cured and the door 12 is dry (i.e., about 4 hours). The exterior skins 48 are formed by applying glue between the layers 50–58 and pressing the skins 48 for several hours at a pressure of about 100 psi. After removal from the press, the exterior skins 48 are placed on a rack (not shown) to thoroughly dry before being attached to the core 14.

Advantageously, the completed door 12 has a simple, economical construction and is easily assembled to provide an effective sound absorbing/insulating barrier to unwanted noise. In particular, the sound damping voids or spaces 30 are easily built into the core 14 of the door 12 with minimal effort and expense.

Other features and advantages of the invention are set forth in the following claims.

I claim:

1. An acoustical wall construction comprising a core including opposite sides, said core having a multiple ply construction including multiple panel plies, each of said panel plies including a periphery having opposite lateral edge portions and opposite longitudinal edge portions, and a plurality of separate spacer plies each fixed between a pair of said panel plies, said panel plies and said spacer plies being coextensive with each other to form a laminated construction, said spacer plies alternating with said panel plies so that each of said panel plies is separated from an adjacent one of said panel plies by an intervening air space, and each of said spacer plies including a pair of opposite lateral spacer strips fixed to the lateral edge portions of a pair of said panel plies, and a pair of opposite longitudinal spacer strips fixed to the longitudinal edge portions of a pair of said panel plies and opposite exterior panels affixed to the opposite sides of said core.

2. An acoustical wall construction as set forth in claim 1 wherein each of said spacer plies includes an inner spacer member fixed between a pair of said panel plies, said inner spacer member being spaced inwardly of said lateral and longitudinal edge portions of the pair of said panel plies to which said inner spacer member is fixed.

3. An acoustical wall construction as set forth in claim 2 wherein each of said lateral spacer strips, said longitudinal spacer strips, and said inner spacer member of each of said spacer plies is adhesively bonded to a pair of said panel plies.

4. An acoustical wall construction as set forth in claim 1 wherein said panel plies include a first outer panel ply made of medium density fiberboard, a second outer panel ply made of hardboard, and a first inner panel ply sandwiched between said first and second outer panel plies, said inner panel ply being made of a sound-insulating material.

5. An acoustical door comprising a laminated multiple ply core including a plurality of panel plies, each of said panel plies including a periphery including opposite lateral edge portions and opposite longitudinal edge portions, and said core including a plurality of spacer plies, said panel plies and said spacer plies being coextensive, and said spacer plies being positioned between successive ones of said panel plies to provide intervening air spaces between said panel plies, and each of said spacer plies including a pair of lateral spacer strips each bonded to said lateral edge portions of a pair of said panel plies, a pair of longitudinal spacer strips each bonded to said longitudinal edge portions of a pair of said panel plies, and inner spacer members each bonded between a pair of said panel plies, said inner spacer members being spaced inwardly from the peripheries of said panel plies, and opposite multiple ply exterior panels fixed to said core.

6. An acoustical door as set forth in claim 5 wherein said core includes at least three of said panel plies and at least two of said spacer plies.

7. An acoustical wall construction comprising a core including opposite sides, said core including a first outer panel ply made of medium density fiberboard, a second outer panel ply made of hardboard, a first inner panel ply sandwiched between said first and second outer panel plies, said first inner panel ply being made of a sound-insulating material, and a second inner panel ply made of vinyl, said second inner panel ply being sandwiched between said first inner panel ply and one of said first outer panel ply and said second outer panel ply, and said core including at least two separate spacer plies, each of said spacer plies including a plurality of spacer members, and each of said spacer plies being fixed between a pair of said panel plies so that said pair of panel plies are separated from one another by an intervening air space, and opposite exterior panels affixed to the opposite sides of said core.

* * * * *